US008944020B2

(12) United States Patent
Remala et al.

(10) Patent No.: US 8,944,020 B2
(45) Date of Patent: Feb. 3, 2015

(54) VALVE LIFTER ASSEMBLY FOR INTERNAL COMBUSTION ENGINE

(75) Inventors: Satish Remala, Peoria, IL (US); Sathishkumar Raman, Paramakudi (IN)

(73) Assignee: Caterpillar Inc., Peoria, IL (US)

( * ) Notice: Subject to any disclaimer, the term of this patent is extended or adjusted under 35 U.S.C. 154(b) by 221 days.

(21) Appl. No.: 13/354,719

(22) Filed: Jan. 20, 2012

(65) Prior Publication Data

US 2013/0152885 A1 Jun. 20, 2013

(30) Foreign Application Priority Data

Dec. 14, 2011 (IN) ..... 3651/DEL/2011

(51) Int. Cl.
*F01L 1/14* (2006.01)

(52) U.S. Cl.
USPC ..... 123/90.5

(58) Field of Classification Search
USPC ..... 123/90.5
See application file for complete search history.

(56) References Cited

U.S. PATENT DOCUMENTS

| | | | | |
|---|---|---|---|---|
| 3,795,229 | A * | 3/1974 | Weber | 123/90.5 |
| 3,886,808 | A * | 6/1975 | Weber | 74/569 |
| 4,089,234 | A * | 5/1978 | Henson et al. | 74/569 |
| 4,724,804 | A | 2/1988 | Wirth | |
| 5,022,356 | A | 6/1991 | Morel, Jr. et al. | |
| 5,088,455 | A | 2/1992 | Moretz | |
| 5,263,386 | A | 11/1993 | Campbell et al. | |
| 5,307,769 | A * | 5/1994 | Meagher et al. | 123/90.5 |
| 6,357,407 | B2 | 3/2002 | Brothers | |
| 6,474,279 | B2 | 11/2002 | Faria | |
| 6,578,535 | B2 * | 6/2003 | Spath et al. | 123/90.16 |
| 6,736,097 | B2 | 5/2004 | Riley | |
| 6,866,014 | B2 | 3/2005 | Spath | |
| 6,932,041 | B1 | 8/2005 | Riley | |
| 6,978,752 | B2 | 12/2005 | Albertson et al. | |
| 6,994,064 | B2 | 2/2006 | Haas et al. | |
| 7,121,244 | B2 * | 10/2006 | Roe et al. | 123/90.5 |
| 7,210,437 | B2 | 5/2007 | Geyer | |
| 8,201,532 | B2 * | 6/2012 | Prokop | 123/90.5 |
| 2004/0194739 | A1 | 10/2004 | Roe et al. | |
| 2010/0294219 | A1 | 11/2010 | Prokop | |

FOREIGN PATENT DOCUMENTS

| | | |
|---|---|---|
| GB | 999507 | 7/1965 |

* cited by examiner

*Primary Examiner* — Thomas Denion
*Assistant Examiner* — Steven D Shipe
(74) *Attorney, Agent, or Firm* — Baker Hostetler

(57) ABSTRACT

An internal combustion engine includes a cylinder block defining a lifter bore, and a valve lifter assembly positioned at least partially within the lifter bore and configured to actuate a push rod. The assembly includes a valve lifter and an angular displacement-limiting clip. A cutout is formed on a proximal end of the valve lifter and includes a channel and a taper. The valve lifter is rotatable out of alignment with a cam, and the clip limits angular displacement of the valve lifter via contacting a wall portion of the cylinder block. First and second fillets of the clip are positionable within the cutout, such that the taper provides a clearance for inhibiting impingement of the valve lifter upon the fillets.

18 Claims, 7 Drawing Sheets

VALVE LIFTER ASSEMBLY FOR INTERNAL COMBUSTION ENGINE

RELATION TO OTHER PATENT APPLICATION

This application claims priority to Indian patent application Ser. No. 3651/DEL/2011, filed Dec. 14, 2011 with the same title.

TECHNICAL FIELD

The present disclosure relates generally to a valve lifter for an internal combustion engine, and relates more particularly to limiting angular displacement of a valve lifter during service.

BACKGROUND

Valve lifters are used in internal combustion engines to convert rotational motion of an engine cam into linear motion, for controlling the position of gas exchange valves. A typical design includes a lifter body coupled with a pushrod configured to actuate a rocker arm of one or more gas exchange valves. The lifter body includes a roller positioned in contact with the engine cam, such that rotation of the engine cam causes the valve lifter to slide within a lifter bore formed in the engine housing. Sliding of the valve lifter adjusts the pushrod, which in turn moves the rocker arm in a well-known manner.

The roller may be generally cylindrical and contacts an outer surface of the cam, such that a desired interface between the roller and the cam outer surface is essentially linear. During service in the engine, valve lifters may become misaligned with the cam via rotation of the valve lifter within the lifter bore. The causes of such misalignment appear to vary from engine to engine. Even seemingly identical engine designs can exhibit different misalignment issues of their valve lifters over the course of the engine's service life. Adding to the complexity, some valve lifters tend to rotate more, or differently than other valve lifters even within the same engine.

Various strategies have been proposed over the years to limit valve lifter rotation. One technique employs a guide mechanism coupled with the valve lifter. U.S. Pat. No. 3,886,808 to Weber teaches such a design. In Weber, the guide mechanism includes a vertically disposed leg which seats in a slot formed on the valve lifter, and a pair of cylindrically shaped arms which seat in a circumferential groove also formed on the valve lifter. A hook connected to the leg seats in a bore in a cylinder block of the engine, apparently preventing the guide and valve lifter from rotation.

Variations on the basic guide design taught by Weber have been developed over the years. As engine designs, duty cycles, and performance characteristics change with continued progress of the art, however, both the nature and extent of valve lifter rotation and its consequences in an engine can change as well. Certain strategies for limiting or otherwise controlling valve lifter rotation that may have been satisfactory in the past have become unsuitable. As is the case with many engineering solutions, such strategies may also have been imperfect to begin with. Failure or damage of a valve lifter and related components can necessitate costly servicing or repair, and shorten the service life of the engine. The poorly understood causes of valve lifter rotation coupled with the desire to avoid redesigning an engine, thus render the pursuit of solutions in this technical area complex and unpredictable.

SUMMARY

In one aspect, an internal combustion engine includes an engine housing having a cylinder block defining a cylinder and a lifter bore, and having a wall portion adjacent the lifter bore. The engine further includes a valve lifter assembly positioned at least partially within the lifter bore, and being configured to actuate a pushrod coupled with a rocker arm for a gas exchange valve of the internal combustion engine. The valve lifter assembly includes a valve lifter, and an angular displacement-limiting clip coupled with the valve lifter. The valve lifter further includes a proximal end, a distal end, and a lifter roller positioned within the distal end and configured to contact a cam of the internal combustion engine, the valve lifter further having a cutout formed on the proximal end and having sidewalls defining a channel and a taper. The valve lifter is rotatable out of alignment with the cam during service in the internal combustion engine. The angular displacement-limiting clip includes a holder engaged with the valve lifter, and a hanger attached to the holder and coupling the valve lifter assembly with the wall portion. The hanger is mated with the channel such that the clip is rotationally coupled to the valve lifter and limits angular displacement of the valve lifter assembly at a stop position defined by contact between the hanger and the wall portion. The clip further includes a first and a second stress defusing fillet transitioning from the holder to the hanger, and being positioned within the cutout such that clearance exists between portions of the sidewalls forming the taper and each of the first and second fillets, for inhibiting impingement of the sidewalls upon the fillets at the stop position.

In another aspect, a valve lifter and displacement-limiting clip assembly for an internal combustion engine includes a valve lifter including an elongate lifter body having an outer peripheral surface, and an inner peripheral surface defining a longitudinal pushrod bore, the pushrod bore having a center axis and extending between a proximal end and a distal end of the lifter body. The lifter body further includes a plurality of axial body segments, including a proximal segment defining an opening to the pushrod bore, a distal segment configured to receive a lifter roller, and a reduced diameter clip segment. The lifter body further includes an indented cutout extending axially through the proximal segment, and having sidewalls defining a channel and a taper. The assembly further includes a clip having a holder engaged with the clip segment, and a hanger attached to the holder and configured to couple the assembly with a wall portion of a cylinder block in the internal combustion engine, such that the clip is rotatable to a stop positions defined by contact between the hanger and the wall portion. The clip further includes a first and a second stress diffusing fillet transitioning from the holder to the hanger. The hanger extends into the cutout and is mated with the channel to rotationally couple the valve lifter to the clip, such that angular displacement of the valve lifter during service is limited at the stop position. The fillets are positioned within the cutout such that a clearance exists between portions of the sidewalls forming the taper and each of the fillets, for inhibiting impingement of the sidewalls upon the first and second fillets at the stop position.

In still another aspect, a valve lifter for an internal combustion engine includes an elongate lifter body having an outer peripheral surface, and an inner peripheral surface defining a longitudinal pushrod bore having a center axis. The lifter body further includes a plurality of axial body segments, including a proximal segment defining an opening to the pushrod bore, a distal segment defining a transverse bore configured to receive a lifter roller, and a clip segment. Each of the proximal, and distal segments defines a full outer diameter dimension, for guiding the valve lifter within a lifter bore in a cylinder block of the internal combustion engine. The clip segment is located axially between the proximal and distal segments and defines a reduced outer diameter dimension, for receiving a holder of a clip about the valve lifter to form an assembly therewith. The lifter body further includes an indented cutout extending axially through the proximal segment, the cutout including sidewalls defining a proximal channel and a distal taper. The channel is configured to mate with a straight section of a hanger of the clip, to rotationally couple the lifter body to clip such that angular displacement of the assembly is limited at a stop position of the clip defined by contact between a curved section of the hanger, and a wall portion of the cylinder block. The taper widens in a distal direction from the channel, to provide a clearance between the sidewalls and stress diffusing fillets transitioning from the holder to the straight section of the hanger, whereby impingement of the sidewalls upon the fillets is inhibited at the stop position.

DETAILED DESCRIPTION

Figure 1:
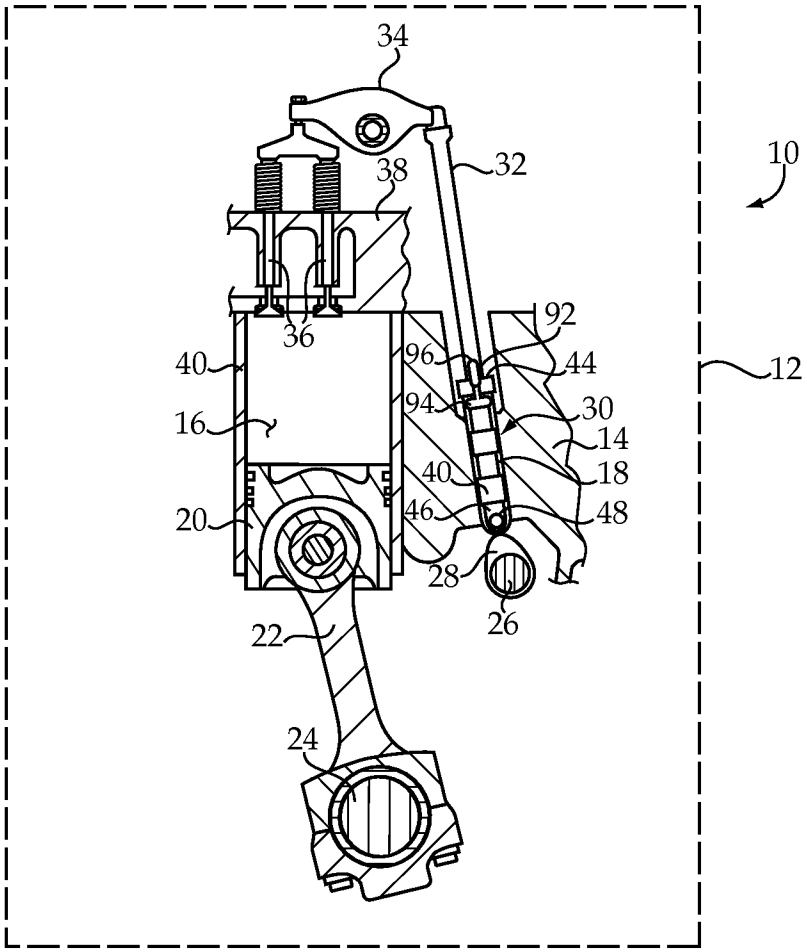
FIG. 1 is a partially sectioned diagrammatic view of an internal combustion engine, according to one embodiment.

Referring to FIG. 1, there is shown an internal combustion engine 10 according to one embodiment. Internal combustion engine 10 may be a compression ignition diesel engine. Engine 10 may include an engine housing 12 having a cylinder block 14 defining a cylinder 16 and a lifter bore 18. A piston 20 is reciprocable within cylinder 16, and coupled with a crankshaft 24 via a piston rod 22 in a conventional manner. Engine 10 may further include a camshaft 26 rotatable in response to rotation of crankshaft 24. In the illustrated embodiment, only one cylinder and one lifter bore are shown, however, it should be appreciated that in most implementations engine 10 will include a plurality of cylinders, a plurality of pistons, and a plurality of lifter bores. Engine 10 may further include a valve lifter assembly 30 positioned at least partially within lifter bore 18. In a practical implementation strategy, two valve lifter assemblies may be associated with each one of the plurality of cylinders. Assembly 30 is configured to actuate a pushrod 32 coupled with a rocker arm 34 for a gas exchange valve 36 of engine 10. Two gas exchange valves 36 are shown, and might comprise intake valves or exhaust valves, and are positioned at least partially within an engine head 38 of housing 12. A cam 28 of camshaft 26 rotates with camshaft 26 to move assembly 30 within lifter bore 18. As will be further apparent from the following description, engine 10 may be uniquely configured for extended service life in comparison with conventional designs. It has been observed that valve lifter assemblies can rotate out of alignment with a cam during service in an internal combustion engine, having undesired and potentially catastrophic consequences. The present disclosure overcomes such shortcomings of known engine designs, and is contemplated to prevent premature failure of components of lifter assembly 30 such that its service life exceeds a service life of engine 10, as further described herein.

Figure 2:
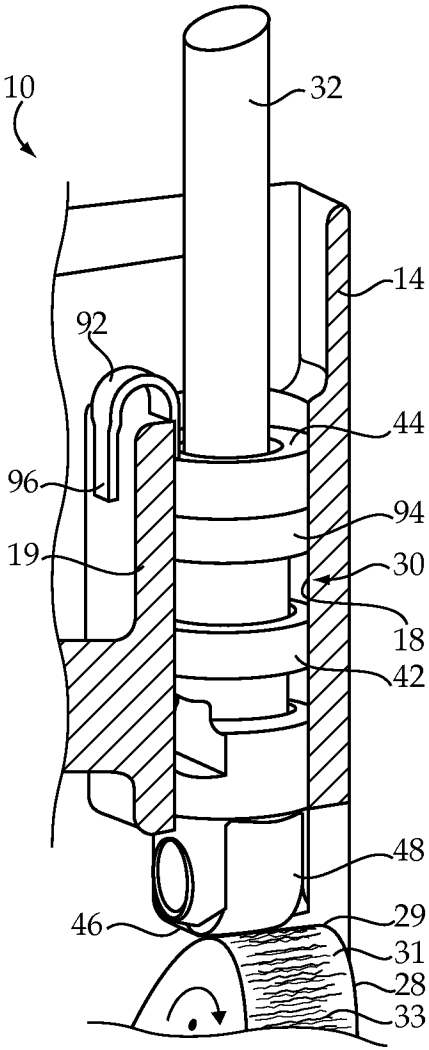
FIG. 2 is a partially sectioned diagrammatic view of a portion of the engine of FIG. 1.

Assembly 30 may include a valve lifter 42, and an angular displacement-limiting clip 92 coupled with valve lifter 42. Valve lifter 42 may have a proximal end 44, a distal end 46, and a lifter roller 48 positioned within distal end 46 and configured to contact cam 28. Clip 92 may include a holder 94 engaged with valve lifter 42 and a hanger 96 attached to holder 94 and coupling valve lifter assembly 30 with a portion of cylinder block 14, in particular a wall portion described below. Referring also now to FIG. 2, there is shown lifter assembly 30 in more detail. Holder 94 is shown coupled with valve lifter 42, and hanger 96 is coupled with a wall portion 19 of cylinder block 14 positioned adjacent lifter bore 18. Lifter roller 48 is shown contacting cam 28, and in particular shown as it might appear where an up-ramp 31 and then subsequently a nose 29 of cam 28 have rotated past roller 48. Wear markings 33 are shown on up-ramp 31 and nose 29. The significance of wear markings on a cam in the diagnosis of the root cause of failure modes of an angular displacement-limiting clip, and the development of the solutions presented herein are further discussed below.

Figure 3:
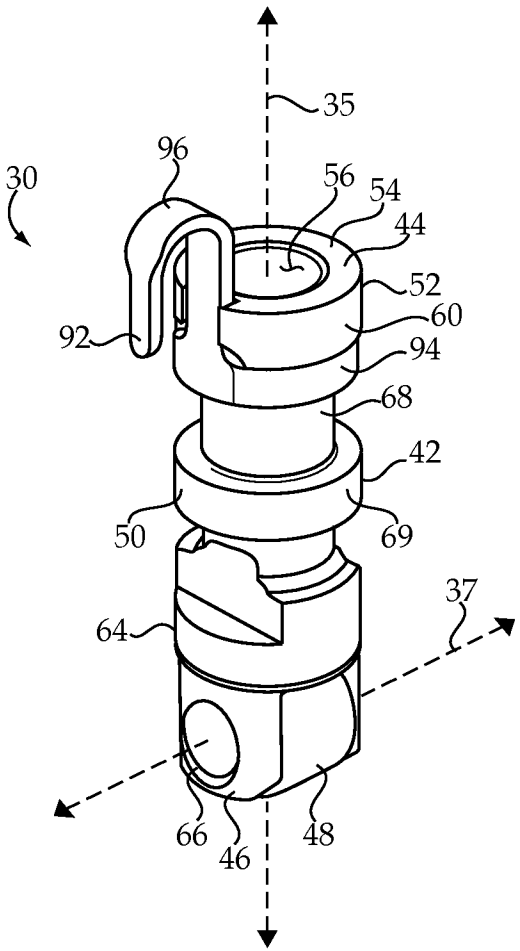
FIG. 3 is a diagrammatic view of an engine valve lifter assembly, according to one embodiment.

Referring now to FIG. 3, there is shown lifter assembly 30 as it might appear removed from service in engine 10, or prior to placing in service therein, and illustrating still further features. Valve lifter 42 may include an elongate lifter body 50 having an outer peripheral surface 52 and an inner peripheral surface 54. Surface 54 defines a longitudinal pushrod bore 56 having a center axis 35. Lifter body 50 further includes a plurality of axial body segments, including a proximal segment 60 defining an opening 62 to bore 56, and a distal segment 64. Distal segment 64 defines a transverse bore 66 having a center axis 37, wherein lifter roller 48 is rotatably positioned. Body 50 may further include a clip segment 68 positioned axially between proximal segment 60 and distal segment 64, a middle segment 69 positioned axially between clip segment 68 and distal segment 64, and a transition segment 71 positioned axially between clip segment 68 and proximal segment 60. Each of proximal segment 60, distal segment 64, and middle segment 69 may include a full diameter segment defining a full outer diameter dimension, whereas clip segment 68 may define a reduced outer diameter dimension 72, for receiving holder 94 about valve lifter 42 to form assembly 30.

Figure 4:
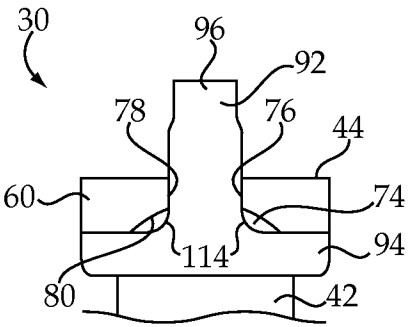
FIG. 4 is a front view of a portion of the engine valve lifter assembly of FIG. 3.

Referring also now to FIG. 4, there is shown a portion of lifter assembly 30 in a front view. Lifter body 50 may further include a cutout 74 extending axially through proximal segment 60, and being indented from outer peripheral surface 52. Cutout 74 includes sidewalls 76 which define a proximal channel 78 and a distal taper 80 of cutout 74. Channel 78 is configured to mate with a straight section of hanger 96, further discussed herein, to rotationally couple lifter body 42 to clip 92 such that angular displacement of lifter assembly 30 is limited via a limitation of angular displacement of clip 92. From FIG. 2, it will be recalled that hanger 96 couples lifter assembly 30 with wall portion 19. An angular displacement-limiting stop position of clip 92 may be defined by contact between a curved section of hanger 96 attached to the straight section, and wall portion 19, in a manner further described herein. From FIG. 4, it may be noted that taper 80 widens in a distal direction from channel 78. Widening of taper 80 in this manner provides a clearance between sidewalls 76 and first and second stress diffusing fillets 114 transitioning from holder 94 to the straight section of hanger 96, such that impingement of sidewalls 76 upon fillets 114 is inhibited at the stop position of clip 92 mentioned above.

Figure 5:
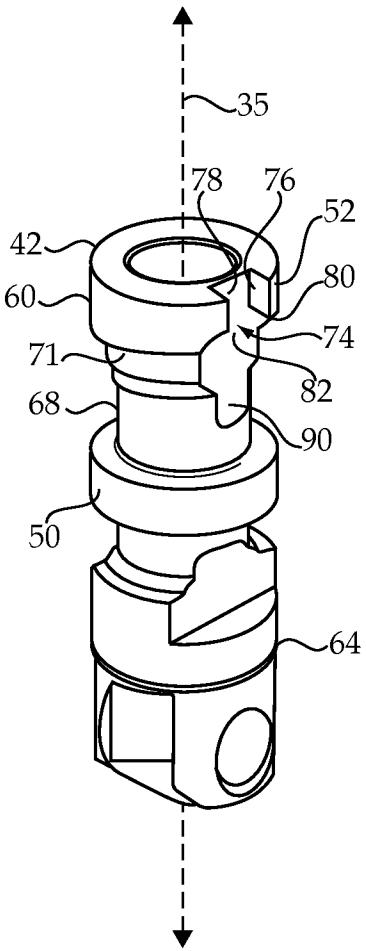
FIG. 5 is a diagrammatic view of an engine valve lifter, according to one embodiment.
Figure 6:
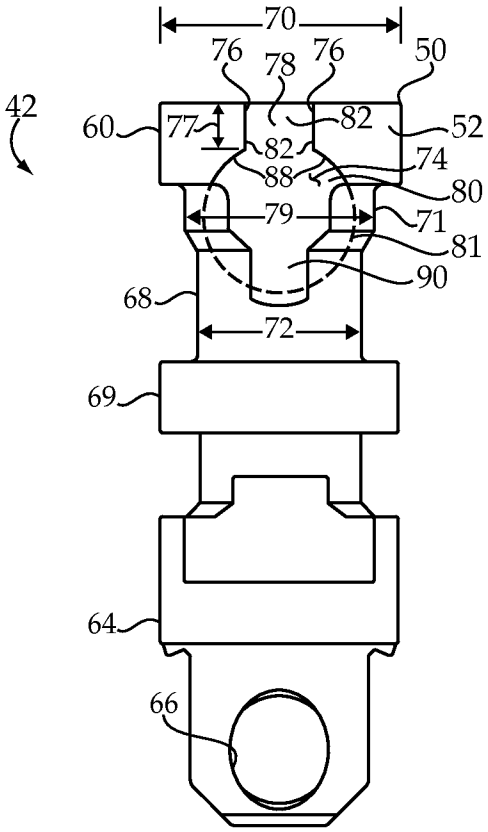
FIG. 6 is a front view of the engine valve lifter of FIG. 5.

Referring now also to FIG. 5, there is shown valve lifter 42 with clip 92 removed. In the illustrated embodiment, cutout 74 includes a planar back wall 82 which extends throughout cutout 74 and is oriented parallel to longitudinal axis 35. Back wall 82 may be oriented normal to sidewalls 76. A planar relief surface 90 may be formed in part on clip segment 68 and in part on transition segment 71 of lifter body 50, such that planar back wall 82 and relief surface 90 are transitionless. Relief surface 90 provides a relief to the outer profile of lifter body 50 to accommodate complementarily shaped features of clip 92, as further discussed herein. Referring also now to FIG. 6, it will be recalled that each of segments 60, 64 and 69 may define a full outer diameter dimension. In FIG. 6, this dimension is illustrated via reference numeral 70, and in a practical implementation strategy may be equal to about 30 millimeters. In one particular embodiment, dimension 70 may be equal to about 29.5 millimeters. The term "about" as used herein should be understood in the context of rounding and a number of significant digits. Accordingly, "about" 30 millimeters means from 25.5 millimeters to 30.4 millimeters, "about" 29.5 millimeters means from 29.45 millimeters to 29.54 millimeters, and so on. Also shown in FIG. 6 is the reduced outer diameter dimension defined by clip segment 68, and shown via reference numeral 72. Dimension 72 may be equal to about 20 millimeters in a practical implementation strategy, and more particularly equal to about 20.9 millimeters. Also shown in FIG. 6 is a channel length dimension 77. Dimension 77 may be equal to about 6 millimeters, and more particularly equal to about 5.7 millimeters.

It may be further noted in the FIG. 6 illustration that sidewalls 76 may be mirror images of one another, and each includes a straight proximal portion 86, and an arcuate distal portion 88, such that straight portions 86 define channel 78 and arcuate portions 88 define taper 80. Straight portions 86 may be parallel one another, and distal portions 88 may be concave, such that cutout 74 defines a chalice shape. Each of arcuate portions 88 may further define arc segments of a common circle 81 having a radius greater than about 5 millimeters, and which may be equal to about 10 millimeters in certain embodiments. Yet another outer diameter dimension 79 is shown in FIG. 6 and defined by transition segment 71. Dimension 79 may be equal to about 24 millimeters, more particularly equal to about 23.6 millimeters. Returning briefly to FIG. 4, it will be recalled that a clearance exists between sidewalls 76 and fillets 114. The clearance may include both an axial and a circumferential clearance. It may also be noted that a concave radius of curvature defined by arcuate portions 88 is larger than the concave radius of curvature defined by each of fillets 114. Still another feature of lifter assembly 30 apparent from FIGS. 3-6 is that proximal segment 60 and distal segment 64 may be understood to define a cylindrical spatial envelope. Holder 94 and part of hanger 96 may be resident within the cylindrical spatial envelope, the significance of which will be further apparent from the following description. Although not visible in FIGS. 3-6, clip 92 may include a planar inboard surface opposed and parallel to relief surface 90 and back wall 82, the planar inboard surface being formed in part on the straight section of hanger 96, and in part upon holder 94.

Figure 8:
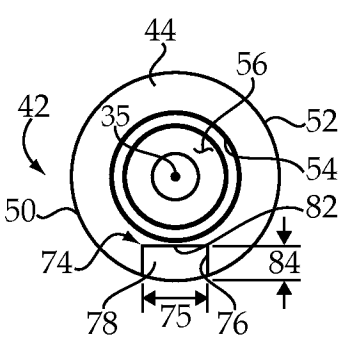
FIG. 8 is a top view of the engine valve lifter of FIGS. 5-7.
Figure 9:
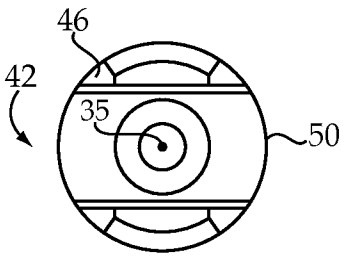
FIG. 9 is a bottom view of the engine valve lifter of FIGS. 5-8.
Figure 7:
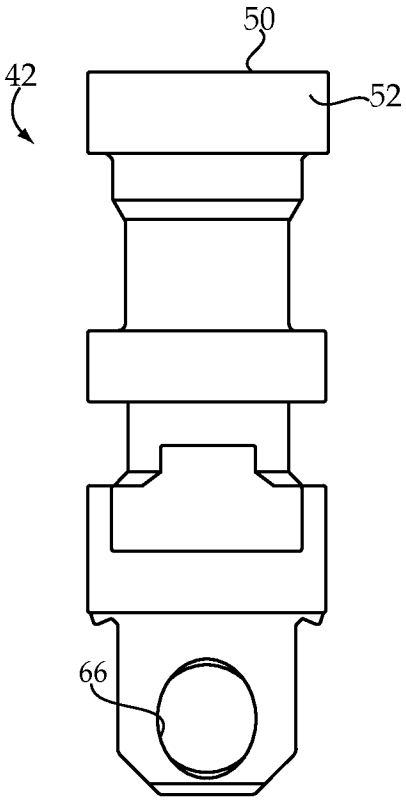
FIG. 7 is a back view of the engine valve lifter of FIGS. 5 and 6.

Referring now to FIG. 7, there is shown a back view of valve lifter 42, rotated approximately 180° from the view shown in FIG. 6. It may be noted that the features of lifter body 50 visible in FIG. 7 may be substantially identical to the features shown in FIG. 6, but for cutout 74 and relief surface 90. Turning to FIG. 8, there is shown a top view of valve lifter 42, in particular as it might appear looking down axis 35 and into bore 56. It may be noted from FIG. 8 that sidewalls 76 are oriented normal to back wall 82, and adjoin back wall 82. Also shown in FIG. 8 is a radial depth 84 of cutout 74, whereby back wall 82 is indented from outer peripheral surface 52. In one practical implementation strategy, depth 84 may be equal to about 15% of full outer diameter dimension 70, or greater. Embodiments are contemplated in which dimension 84 is equal to about 5 millimeters, and more particularly equal to about 4.75 millimeters. A width dimension 75 of cutout 74 is also shown, and may be equal to about 9 millimeters, and in certain embodiments about 8.8 millimeters. Referring to FIG. 9, there is shown a bottom view of valve lifter 42, as it might appear looking in a proximal direction along axis 35.

Figure 10:
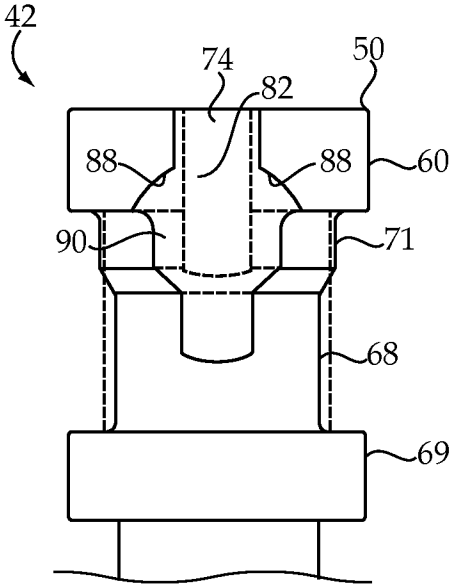
FIG. 10 is a front diagrammatic view of the engine valve lifter of FIGS. 5-9, comparing a shape of certain features of the engine valve lifter with a known design.

Turning to FIG. 10, there is shown a view of a portion of valve lifter 42, and illustrating differences in certain geometric attributes of valve lifter 42 as compared with a known valve lifter design. In FIG. 10, certain features of the known valve lifter design are shown via dashed lines. It may be noted, for instance, that the known lifter design includes a cutout, but the cutout forms only a relatively narrow channel and has no taper at all. While the known design includes a planar surface transitioning with its cutout, this surface is narrower, shorter, and differently shaped than planar relief surface 90 of valve lifter 42. The transition segment in the known valve design is slightly narrower than transition segment 71, whereas the clip segment in the known lifter design has a relatively larger outer diameter dimension than that defined by clip segment 68. While not readily apparent due to the viewpoint of FIG. 10, the depth of cutout 74, dimension 84, may also be greater than a depth of the cutout in the known design.

Figure 12:
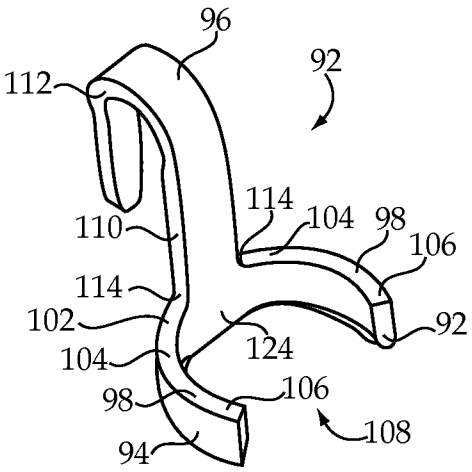
FIG. 12 is another diagrammatic view of the clip of FIG. 11.
Figure 11:
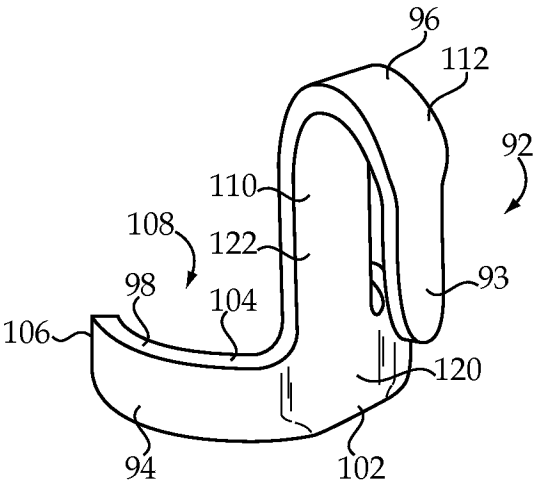
FIG. 11 is a diagrammatic view of an angular displacement-limiting clip according to one embodiment.

Turning now to FIGS. 11 and 12, there are shown two different views of clip 92 and illustrating certain features in further detail. Clip 92 may include a one-piece metal body 93, formed for example from a single stamping, the one-piece metal body 93 including holder 94 and hanger 96, and being configured to couple with valve lifter 42 to form lifter assembly 30 as noted above. Holder 94 may include a first jaw 98 and an opposed second jaw 98, and a base 102 connecting jaws 98. Each of jaws 98 may be arcuate, whereas base 102 may be straight, such that holder 94 forms a C-shape in a first plane. The C-shape is readily apparent in FIG. 12. Each of jaws 98 may include a proximal end 104 adjoining base 102, and a free distal end 106. In clip 92, "proximal" means closer to a location where hanger 96 attaches to holder 94, whereas "distal" means away from that location. Holder 94 further includes an open side 108 defined by free distal ends 106, for clipping holder 94 about clip segment 68 of valve lifter 42 to form lifter assembly 30. Hanger 96 projects from holder 94 in a direction normal to the first plane. Thus, while hanger 96 indeed curves, its overall direction of projection may be understood to be normal to the plane in which the C-shape lies. Hanger 96 may further include a straight proximal section 110, as noted above, connecting to base 102 and being positionable within cutout 74 to rotationally couple clip 92 to lifter 42. Hanger 96 may further include a distal section 112. Distal section 112 curves such that when clip 92 is assembled with lifter 42, distal section 112 curves radially outward of axis 35. In certain embodiments, distal section 112 may be understood to form a U-shape in a second plane normal to the first plane, and is configured to couple clip 92 and by implication lifter assembly 30 with wall portion 19 as described herein.

It will be recalled that clip 92 may include a planar inboard surface which is positionable in opposition to and parallel to back surface 82 and relief surface 90 of lifter body 50. In FIG. 12, the planar inboard surface 124 formed on body 93 is shown. Opposite surface 124 is a planar outboard surface 120 formed on base 102. Straight section 110 of hanger 96 may include another planar outboard surface 122 adjoining and transitioning with outboard surface 120. It has been observed that known clip designs having an unrelieved outer profile can scuff against a lifter bore as a lifter assembly which includes that clip rotates within the lifter bore. Body 93 may be understood to include an anti-scuffing outer profile configured to inhibit interference between base 94 and lifter bore 18 during rotating lifter assembly 30 within lifter bore 18. The anti-scuffing outer profile is defined in part by surface 120, which does not tend to contact lifter bore 18, such that interference between lifter bore 18 and clip 92 occurs predominantly via distal ends 106. In one practical implementation strategy, the anti-scuffing outer profile may include a first arcuate segment defined by a first one of jaws 98, a second arcuate segment defined by the other of jaws 98, and a linear segment defined by base 102. The anti-scuffing outer profile and its respective segments are most apparent in the first plane mentioned above, and will be further understood by way of subsequent description.

Figure 13:
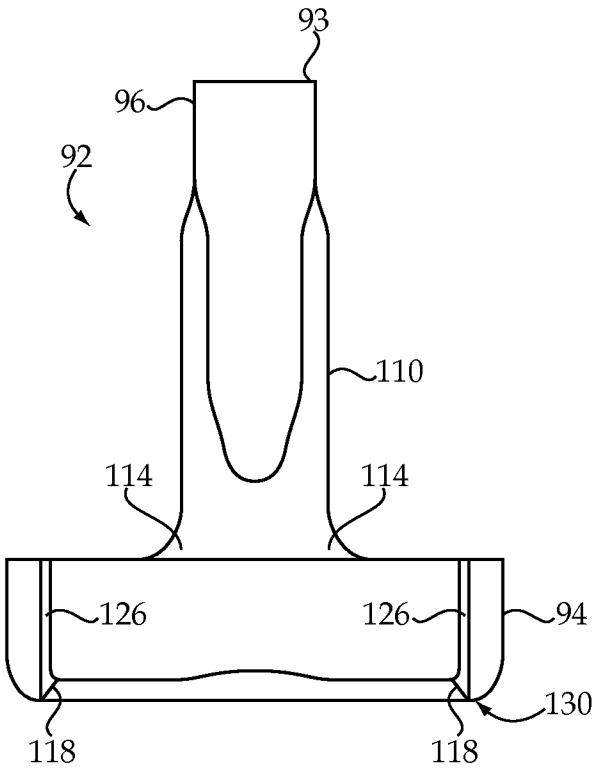
FIG. 13 is a front view of the clip of FIGS. 11 and 12.

Referring now to FIG. 13, there is shown a front view of clip 92. It may be noted that body 93 forms a T-shape in a third plane, the plane of the page in FIG. 13, which is normal to each of the first and second planes. It may further be noted that holder 94 includes a planar upper edge surface 116, and a non-planar lower edge surface 118. Each of fillets 114 arcs upwardly from planar upper edge surface 116 to hanger 96. Each of fillets 114 may further define a radius in the third plane which is from about 2 millimeters to about 4 millimeters. The radiuses defined by fillets 114 may be equal to about 3 millimeters in certain embodiments. Radiuses of the disclosed sizes have been found to impart appropriate stress diffusion properties to inhibit fatigue failure of clip 92, in particular hanger 96, in service. Radiuses of the disclosed sizes are also consistent with other considerations such as the ability to mate clip 92 with valve lifter 42 without unduly changing the shape of valve lifter 42, avoiding impingement of sidewalls 76 on fillets 114, and manufacturability. Also shown in FIG. 13 is an installation assist taper 130 which facilitates sliding assembly 30 into lifter bore 18. Installation assist taper 130 narrows in a direction opposite the direction of projection of hanger 96.

Figure 14:
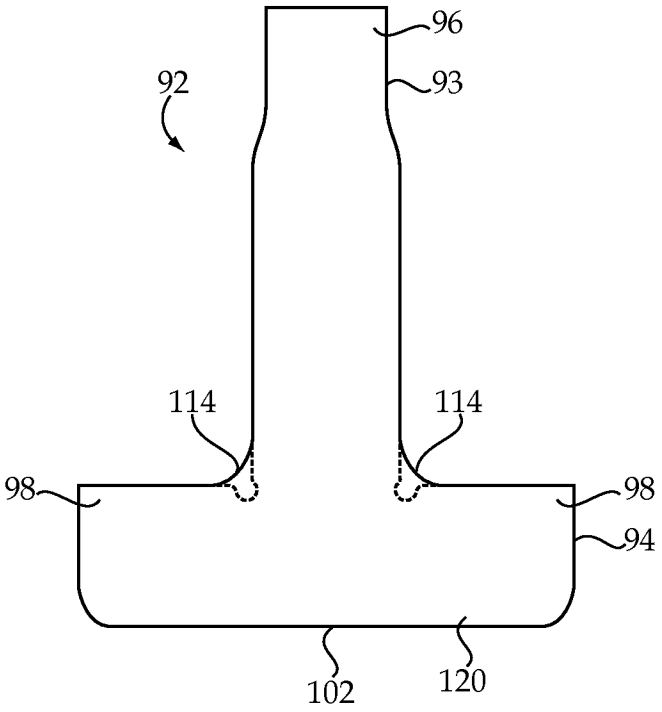
FIG. 14 is a back view of the clip of FIGS. 11-13.

Referring to FIG. 14, there is shown a back view of clip 92, and illustrating certain geometric attributes of body 93 in comparison with geometric attributes of a known clip shown by way of dashed lines. In may be noted that the known clip design does not include stress diffusing fillets at all, but instead includes voids defined by an upper edge of the clip curving downwardly initially from the holder before commencing to curve upwardly and transition to the hanger. The third plane discussed above includes the plane of the page in FIGS. 13 and 14.

Figure 16:
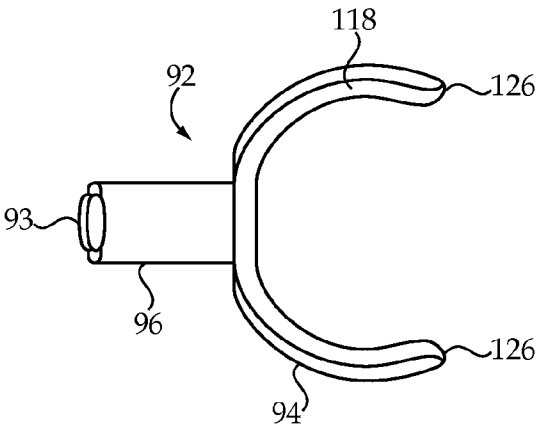
FIG. 16 is a bottom view of the clip of FIGS. 11-15.
Figure 15:
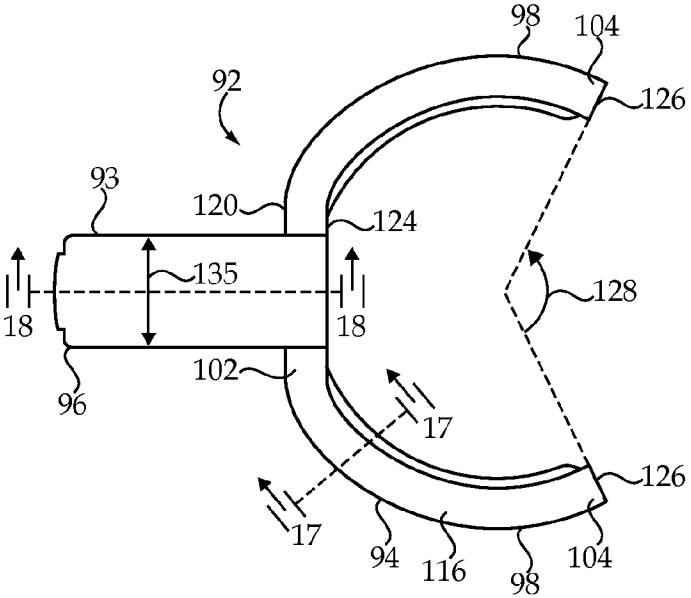
FIG. 15 is a top view of the clip of FIGS. 11-14.

Turning to FIG. 15, there is shown a top view of clip 92, and illustrating an angle 128 defined by distal end surfaces 126 of each of jaws 98. The first plane mentioned above is the plane of the page in FIG. 15. In one practical implementation strategy, angle 128 may be equal to about 110° or greater. Such an angle has been found to enable jaws 98 to spread apart to enlarge open side 108 for engaging clip 92 about valve lifter 42. It may also be noted that jaws 98 are arcuate, and mirror images of one another. A hanger width dimension 135 may be equal to about 9 millimeters, and more particularly equal to about 8.58 millimeters, enabling straight section 110 to mate within channel 78. Referring to FIG. 16, there is shown a bottom view of clip 92, and illustrating non-planar lower surface 118. Forming installation assist taper 130 may take place by bending lower sides of jaws 118 inwardly, such that lower surface 118 assumes a generally conical shape, at least within jaws 118. Each distal end surface 126 may also be machined to remove sharp edges, as evidenced by the curving shape of distal end surfaces 126 as they transition with lower surface 118.

Figure 17:
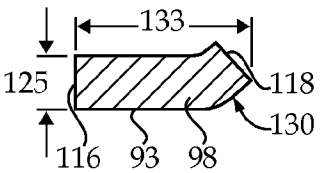
FIG. 17 is a sectioned view taken along line 17-17 of FIG. 15.
Figure 18:
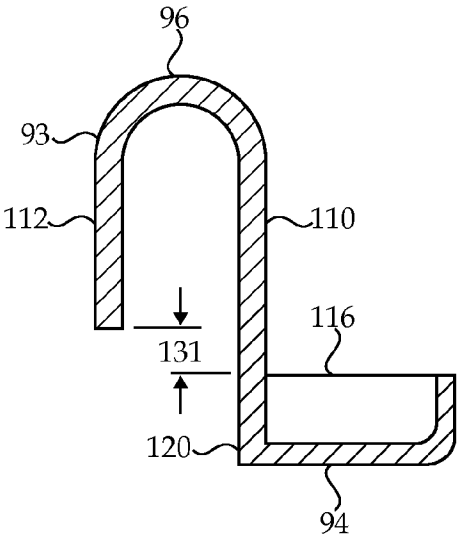
FIG. 18 is a sectioned view taken along line 18-18 of FIG. 15.

Referring now to FIG. 17, there is shown a sectioned view taken along line 17-17 of FIG. 15. In the sectioned view of FIG. 17, a jogged profile between upper surface 116 and lower surface 118 is readily apparent. Also shown in FIG. 17 is a thickness dimension 125 of body 93. In certain embodiments, thickness 125 may be uniform throughout body 93, and may be less than the radiuses defined by fillets 114. Thickness 125 may be from about 2 millimeters to about 4 millimeters, more particularly from about 2.0 millimeters to about 3.0 millimeters, and still more particularly equal to about 2.5 millimeters. Also shown in FIG. 17 is a holder height dimension 133 measured from upper surface 116 to a lowermost part or tip of holder 94, adjoining or part of lower surface 118. Dimension 133 may be equal to about 8 millimeters in one embodiment, and more particularly equal to about 8.13 millimeters. Referring to FIG. 18, there is shown a sectioned side view taken along line 18-18 of FIG. 15. The second plane discussed above includes the plane of the page in FIG. 18. FIG. 18 illustrates a hanger height dimension 131, as measured from upper surface 116 to a tip of distal section 112 of hanger 96. Dimension 131 may be equal to about 5 millimeters in one embodiment, and more particularly equal to about 4.6 millimeters. Also shown in FIG. 18 is a linear profile defined by planar surfaces 120 and 122.

Figure 19:
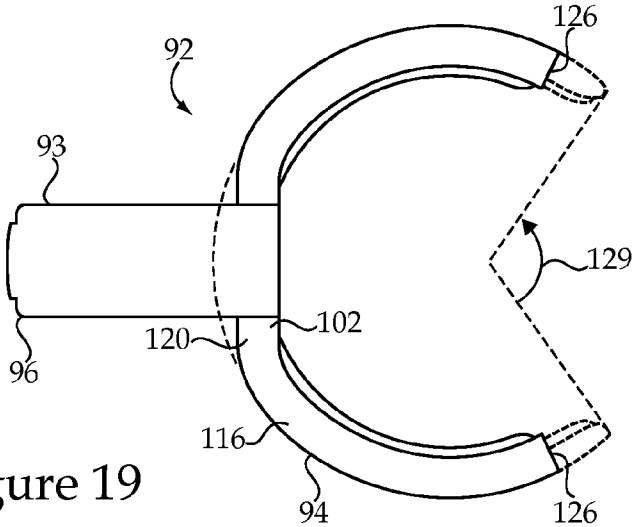
FIG. 19 is a diagrammatic view of the clip of FIGS. 11-18, comparing a shape of certain features of the clip with a known design.

Referring now to FIG. 19, there again is shown clip 92 and comparing certain geometric attributes of body 93 with those of a known clip design. It will be recalled that body 93 includes an anti-scuffing outer profile, and that known clip designs tended to have an outer profile which did not prevent scuffing a lifter bore. In FIG. 19, certain features of the known clip design are shown by way of dashed lines. It may be noted that rather than an outer profile having a linear segment defined by surface 120, in the known clip design an unrelieved, curving profile was used. Also shown in FIG. 19 is another angle 129 which might be defined by distal end surfaces of jaws of a holder in the known clip design. Angle 129 is less than angle 128. The thickness of the body of the known clip is also less than thickness 125.

Industrial Applicability

Figure 20:
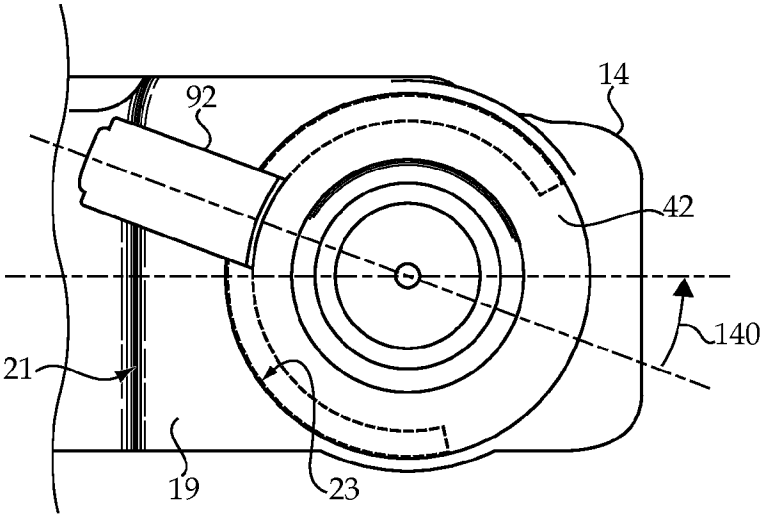
FIG. 20 is a top view of an engine valve lifter assembly positioned within a cylinder block of an engine.

Referring to the drawings generally, engine 10 operates via combustion of a mixture of fuel and air in cylinder 16, driving piston 20 to rotate crankshaft 24 in a conventional manner. Rotation of crankshaft 24 will induce camshaft 26 to rotate, causing cam 26 to rotate against roller 48 and sliding valve lifter 42 upward within lifter bore 18 to open valve(s) 36. Biasing springs coupled with rocker arm 34 will tend to return valve lifter 42 toward camshaft 26, and close valve(s) 36. It will be recalled that clip 92 is rotationally coupled to valve lifter 42 in service in engine 10. During operation of engine 10, valve lifter 42 may rotate out of alignment with cam 28. Due to the rotational coupling of clip 92 to valve lifter 42, a torque which rotates valve lifter 42 is transmitted to clip 92 such that clip 92 rotates concurrently with valve lifter 42. In particular, torque may be transmitted at least predominantly via contacting straight portions 86 of sidewalls 76 with straight section 110 of hanger 96. Hanger 96 is coupled with wall portion 19 in engine 10. Clearances will typically exist between hanger 96 and each of an outer side and an inner side of wall portion 19, in contrast with earlier designs where the clip contacted at least the inner side of a cylinder block wall portion. Inner side 23 and outer side 21 of wall portion 19 are shown in FIG. 20. Inner side 23 may be rounded and transitions with lifter bore 18, whereas outer side 21 may have a generally straight shape such that rotating clip 92 concurrently with valve lifter 42 shifts hanger 96 to reduce clearances with wall portion 19. Rotation of valve lifter 42 and clip 92 will tend to continue until the clearances are reduced to zero, such that contact between hanger 96 and wall portion 19 stops rotation of clip 92 and thus valve lifter 42.

In FIG. 20, clip 92 is shown as it might appear where valve lifter 42 has been rotated out of alignment with cam 28, and then its rotation stopped at an angular displacement-limiting stop position defined by contact between clip 92 and wall portion 19. An angle 140 is also shown in FIG. 20 and identifies an approximate angular displacement of valve lifter 42 and clip 92 that may occur between a position of valve lifter 42 aligned with cam 28 and the angular displacement-limiting stop position. Angle 140 may be equal to about 20° in one embodiment. Different valve lifter assemblies may behave differently from one another in service. In many instances, clip 92 may be rotatable about 20° in either of a clockwise and a counterclockwise direction from an aligned position. Thus, clip 92 might be rotatable a total of about 40° between two angular displacement limiting stop positions. Depending upon the engine and the individual valve lifter assembly, however, this angle may vary. Moreover, certain valve lifter assemblies may have a tendency to be rotated more in one direction than the other. In any event, forces may be applied to a lifter assembly at one or more angular displacement-limiting stop positions, inducing stresses in the clip. In clip 92 these stresses are diffused via fillets 114 such that fatigue failure of clip 92 is inhibited, and a service life of lifter assembly 30 exceeds a service life of engine 10. For reasons further explained below, the root causes of such stresses, and the development of viable solutions, have long been elusive.

Those skilled in the art will be familiar with the concept of engine dynamics. As an internal combustion engine operates, many different linear and rotational forces, vibrations, thermally-induced dimensional changes, and other factors, can combine, add, subtract, and otherwise interact with one another in cross-coupled and unpredictable ways. Accordingly, any given component or process, despite best engineering efforts, can behave, perform, or take place in ways different from what is intended. Even seemingly miniscule changes in component geometry, engine operating parameters, or other features can have substantial and unpredictable effects on engine dynamics. As alluded to above, substantial variation among seemingly identical engines, and variation in phenomena even among seemingly identical parts within an engine, is commonly observed. Rotation of valve lifters is one phenomenon that is believed to result from the complex phenomena of engine dynamics. Challenges in fully characterizing engine dynamics have contributed to the difficulty in solving the problems of lifter rotation, and prevented various possible solutions to lifter rotation and its consequences from being predictable.

In earlier clip designs, such as the design shown in comparison to clip 92 in FIGS. 14 and 19, fatigue failure of the clip sometimes occurred prior to the end of the normal service life of the associated engine. Two general failure modes have been observed in known clip designs. In certain instances, the hanger can fail approximately where its straight section transitions to its distal section or within the curved distal section itself. In other instances, the hanger can fail at the "root," approximately where the straight section attaches to the holder. It is believed that the latter failure mode tends to occur where a relatively greater clearance exists between a straight section of the clip's hanger and sidewalls of the channel formed in the associated valve lifter. The former failure mode tends to occur where the clearance is relatively tighter. Tolerance stack-up between the clip and valve lifter is believed to be at least partly responsible for these variations from lifter assembly to lifter assembly. It was only after extensive research that the common root causes of these different failure modes were revealed.

It will be recalled that wear marks 33 may form on cam 28 during service from contact with lifter roller 48, as illustrated in FIG. 3. It may be noted that marks 33 vary somewhat in width, but are generally left to right symmetric upon cam 28. In the course of research on lifter assembly failure leading to the present disclosure, it was proposed that such a wear pattern might be observed where a valve lifter self-aligns. This means that while the valve lifter may be angularly displaced during service, it likely has a tendency to settle back to a desired orientation, resulting in a wide, symmetric wear pattern over time. It was also observed that lifter assemblies tending to self-align appeared to have a reduced incidence of clip fatigue failure. In known designs which failed, it was further observed that wear marks on the corresponding cam appeared different from marks 33, sometimes being thinner and less symmetric, and thus suggesting that the valve lifter failed to self-align, at least some of the time. The reasons for failure to self-align at this juncture remained unknown.

Figure 21:
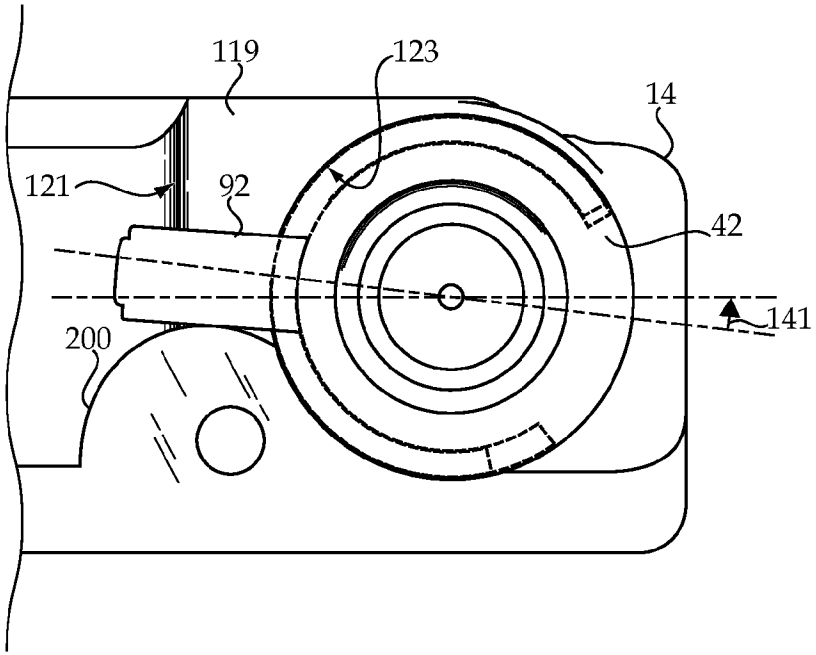
FIG. 21 is a top view of an engine valve lifter assembly positioned within a cylinder block of an engine.

Referring to FIG. 21, there is shown a valve lifter 142 and clip 192 positioned within a cylinder housing 114, such that the hanger of clip 192 is coupled with a wall portion 119 having an outer side 121 and an inner side 123. Unlike the configuration shown in FIG. 20, lifter 142 and clip 192 are installed such that an inherent misalignment is created due to the position of a bolting boss 200. In other words, clip 192 and lifter 142 are not capable of being installed at precisely a desired orientation with respect to a corresponding cam. In the illustrated example, lifter 142 and clip 192 can only be installed at an orientation defining an angle 141 which is about 10° off from a desired orientation.

Upon observing wear patterns on many different cams, including those coupled with both inherently misaligned and self-aligning lifter assemblies, it was discovered that the inherent misalignment may result in a distinctive wear pattern on the corresponding cam that has similarities with, but is not identical to, wear patterns observed on cams associated with failed clips. By still further examining the features of engines and many lifter assemblies where clips have failed, it was further concluded that inherently misaligned lifter and clip assemblies are themselves associated with increased risk of failure. The similarities in wear pattern, and apparent shared likelihood of fatigue failure of the clip, ultimately led to the hypothesis that failed clips were likely to have experienced service conditions analogous with that of inherently misaligned clips. While the nature of these service conditions still remained unknown, additional observations as to scuff marks on the lifter bore finally led to the conclusion that various factors must have been causing clips to "hang-up" within the lifter bore and fail to self-align, resulting in stresses sufficient to eventually result in fatigue failure. This conclusion itself ran counter to the conventional wisdom that valve lifters would always tend to self-align. Once the phenomenon of lifter assemblies, and in particular the clip, hanging-up began to be revealed, it became possible to investigate the potential reasons. It is now believed that variations from engine to engine, and amongst lifter assemblies, results in a tendency for some lifter assemblies to experience constraints on their rotation based on interaction with the cylinder block, whilst others can rotate more freely. Variations in the dimensions of cylinder block wall portions from one engine to another may be one specific reason why some valve lifters behave differently than others, and fail to reliably return from a displaced position to an aligned position. Regardless of the specific causes behind failure to self-align, bending and twisting loads on the clip, ultimately leading to the observed failure modes, are believed to be most acute where a lifter assembly hangs up at the angular displacement limiting stop position(s), and the lifter roller is then contacted by the rotating up-ramp and nose of the associated cam.

The present disclosure addresses the problems of clip failure in valve lifter assemblies such that a service life of an engine may be extended, at least in part by designing clip 92 to be more tolerant of such bending and twisting loads, and by designing valve lifter 42 to optimally accommodate clip 92. As discussed above, clip 92 and valve lifter 42 each differ in a number of ways from known designs. These differences complement each other such that the failure modes discussed above can no longer occur, or take so long to occur during normal engine operation, that the service life of lifter assembly 30 exceeds a service life of engine 10. Those skilled in the art will be familiar with the undesirability of changing an overall engine design, incorporating new components, changing spatial footprints of components or assemblies, and other radical and expensive changes. As discussed above, engine dynamics may change in substantial and unpredictable ways even when small changes are made. Solutions to one challenge or problem may be effective, but quite commonly create new and unexpected failure modes or have other disadvantages, not to mention additional costs.

The features of clip 92 and valve lifter 42, and the manner in which those features interact with one another as well as other parts of engine 10, however, conservatively advance over known designs without creating new failure modes and without requiring modifications to an engine itself. Clip 92 may be thicker and differently shaped than known designs, as noted above. The thickness of clip 92 is believed to make body 93 more robust, whereas fillets 114 diffuse stresses which might otherwise cause fatigue failure, and the anti-scuffing outer profile prevents drag of the clip against lifter bore 18 as the clip rotates to and from an angular displacement-limiting stop position. In a practical implementation strategy, clip 92 may be designed such that distal ends 118 have a relatively mild interference fit with lifter bore 18, and the rest of holder 94 does not interfere at all. Clips contemplated herein may also have reduced or eliminated interference between the hanger and the wall portion of the cylinder block, contrasting with prior designs in which the lower part of the hanger bulged outwardly somewhat and created what is now recognized as undesirable interference with the lifter bore. In the case of valve lifter 42, the relieved outer surface 90 enables a snugger and better matched fit with clip 92, the relatively deeper cutout 74 accommodates the increased thickness of clip 92, and taper 80 ensures that sidewalls 76 will not impinge upon fillets 114. Lifter assembly 30 will typically have a spatial footprint such that lifter assembly 30 can be installed within engine 10 without requiring any other modification to hardware or operating strategy. Thus, the present disclosure may be understood in certain respects as reallocating a fixed quantity of material from one component to another, without changing the spatial footprint from the footprint available for existing valve lifter assemblies. Engines where valve lifter assemblies have failed, or where failure is deemed possible, can thus be serviced by swapping out existing valve lifter assemblies for lifter assemblies according to the present disclosure.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. For instance, while certain features of clip 92 and lifter 42 have been described herein as having example dimensional and geometric attributes, the present disclosure is not thereby limited and alternative implementations may be developed based on the teachings. Other aspects, features and advantages will be apparent upon an examination of the attached drawings and appended claims.

The invention claimed is:

1. An internal combustion engine comprising:

an engine housing including a cylinder block defining a cylinder and a lifter bore, and having a wall portion adjacent the lifter bore;

a valve lifter assembly positioned at least partially within the lifter bore, and being configured to actuate a pushrod coupled with a rocker arm for a gas exchange valve of the internal combustion engine, the valve lifter assembly including a valve lifter, and an angular displacement-limiting clip coupled with the valve lifter;

the valve lifter having a proximal end, a distal end, and a lifter roller positioned within the distal end and configured to contact a cam of the internal combustion engine, the valve lifter further having a cutout formed on the proximal end and having sidewalls defining a channel and a taper, and the valve lifter being rotatable out of alignment with the cam during service in the internal combustion engine;

the angular displacement-limiting clip having a holder engaged with the valve lifter, and a hanger coupling the valve lifter assembly with the wall portion, the hanger being mated with the channel such that the clip is rotationally coupled to the valve lifter and limits angular displacement of the valve lifter assembly at a stop position defined by contact between the hanger and the wall portion;

the clip further including an anti-scuffing outer profile facing the lifter bore and having a first and a second arcuate segment upon the holder, and a linear segment extending between the arcuate segments, so as to inhibit interference between the clip and the lifter bore during rotation of the valve lifter assembly within the lifter bore; and the clip further including a first and a second stress diffusing fillet transitioning from the holder to the hanger, and being positioned within the cutout such that a clearance exists between portions of the sidewalls forming the taper and each of the first and second fillets, for inhibiting impingement of the sidewalls upon the fillets at the stop position.

2. The engine of claim 1 wherein the clearance includes an axial and a circumferential clearance.

3. The internal combustion engine of claim 2 wherein the holder is C-shaped, and the hanger includes a straight section connecting with the holder, and a U-shaped section coupling the assembly with the wall portion.

4. The internal combustion engine of claim 3 wherein straight proximal portions of the sidewalls define the channel, and arcuate distal portions of the sidewalls are concave within the taper and define arc segments of a common circle.

5. The internal combustion engine of claim 1 wherein the cutout defines a chalice shape.

6. A valve lifter and displacement-limiting clip assembly for an internal combustion engine comprising:

a valve lifter including an elongate lifter body having an outer peripheral surface, and an inner peripheral surface defining a longitudinal pushrod bore, the pushrod bore having a center axis and extending between a proximal end and a distal end of the lifter body;

the lifter body further having a plurality of axial body segments, including a proximal segment defining an opening to the pushrod bore, a distal segment configured to receive a lifter roller, and a reduced diameter clip segment, the lifter body further having an indented cutout extending axially through the proximal segment and having sidewalls defining a channel and a taper;

a clip having a holder engaged with the clip segment, and a hanger attached to the holder and configured to couple the assembly with a wall portion of a cylinder block in the internal combustion engine, such that the clip is rotatable to a stop position defined by contact between the hanger and the wall portion, and the clip further including a first and a second stress diffusing fillet transitioning from the holder to the hanger;

the clip further including an anti-scuffing outer profile having a first and a second arcuate segment upon the holder, and a linear segment extending between the arcuate segments, so as to inhibit interference between the clip and the lifter bore during the rotation of the clip; and the hanger extending into the cutout and mated with the channel to rotationally couple the valve lifter to the clip, such that angular displacement of the valve lifter during service is limited at the stop position, and the fillets being positioned within the cutout such that a clearance exists between portions of the sidewalls forming the taper and each of the fillets, for inhibiting impingement of the sidewalls upon the fillets at the stop position.

7. The assembly of claim 6 wherein the holder has a C-shape, and the hanger has a straight section connecting to the holder and mated with the channel, and a second section, the second section being configured to contact the wall portion and having a U-shape curving radially outwardly of the valve lifter.

8. The assembly of claim 7 wherein straight proximal portions of the sidewalls define the channel, and arcuate distal portions of the sidewalls define the taper.

9. The assembly of claim 8 wherein each of the arcuate sidewall portions defines a first concave radius of curvature, and each of the fillets defines a second concave radius of curvature.

10. The assembly of claim 9 wherein the first concave radius of curvature is larger than the second concave radius of curvature.

11. The assembly of claim 9 wherein the lifter body further includes a planar relief surface formed on the clip segment, and the clip further includes a planar inboard surface opposed and parallel to the planar relief surface and being formed in part on the straight section of the hanger, and in part upon the holder.

12. The assembly of claim 8 wherein the proximal segment and the distal segment of the lifter body define a cylindrical spatial envelope, and the holder and the straight section of the hanger are resident within the cylindrical spatial envelope.

13. A valve lifter for an internal combustion engine comprising:

an elongate lifter body having an outer peripheral surface, and an inner peripheral surface defining a longitudinal pushrod bore having a center axis;

the lifter body further having a plurality of axial body segments, including a proximal segment defining an opening to the pushrod bore, a distal segment defining a transverse bore configured to receive a lifter roller, and a clip segment, each of the proximal and distal segments defining a full outer diameter dimension, for guiding the valve lifter within a lifter bore in a cylinder block of the internal combustion engine;

the clip segment being located axially between the proximal and distal segments and defining a reduced outer diameter dimension, for receiving a holder of a clip about the valve lifter to form an assembly therewith;

the lifter body further having an indented cutout extending axially through the proximal segment, the cutout including sidewalls defining a proximal channel and a distal taper;

the channel being configured to mate with a straight section of a hanger of the clip, to rotationally couple the lifter body to the clip such that angular displacement of the assembly is limited at a stop position of the clip defined by contact between a curved section of the hanger, and a wall portion of the cylinder block; and the taper widening in a distal direction from the channel, to provide a clearance between the sidewalls and stress diffusing fillets transitioning from the holder to the straight section of the hanger, such that impingement of the sidewalls upon the fillets is inhibited at the stop position;

wherein the cutout includes a planar back wall oriented parallel the longitudinal axis and adjoining the sidewalls; and wherein the lifter body further includes a cylindrical outer surface and a planar relief surface each formed upon the clip segment, and an outer profile that is linear upon the planar relief surface and arcuate upon the cylindrical outer surface, and the planar relief surface being transitionless with the planar back wall of the cutout.

14. The valve lifter of claim 13 wherein the planar back wall is indented from the outer peripheral surface a distance defining a radial depth of the cutout, and the radial depth of the cutout being equal to about 15% of the full outer diameter dimension, or greater.

15. The valve lifter of claim 13 wherein the sidewalls are mirror images of one another and each include a straight proximal portion, and an arcuate distal portion, the straight proximal portions defining the channel, and the arcuate distal portions defining the taper.

16. The valve lifter of claim 15 wherein the straight proximal portions are parallel and the arcuate distal portions are concave, such that the cutout defines a chalice shape.

17. The valve lifter of claim 16 wherein the arcuate portions define arc segments of a common circle having a radius greater than about 5 millimeters.

18. The valve lifter of claim 13 wherein the full outer diameter dimension is equal to about 30 millimeters, and the reduced outer diameter dimension is equal to about 20 millimeters.

* * * * *

UNITED STATES PATENT AND TRADEMARK OFFICE

CERTIFICATE OF CORRECTION

PATENT NO. : 8,944,020 B2
APPLICATION NO. : 13/354719
DATED : February 3, 2015
INVENTOR(S) : Remala et al.

It is certified that error appears in the above-identified patent and that said Letters Patent is hereby corrected as shown below:

In the Specification:

Column 9, line 5, delete "Industrial Applicability" and insert -- INDUSTRIAL APPLICABILITY --.

Signed and Sealed this
Seventeenth Day of November, 2015

Michelle K. Lee

Michelle K. Lee
*Director of the United States Patent and Trademark Office*